US008198556B2

(12) United States Patent
Majewski et al.

(10) Patent No.: US 8,198,556 B2
(45) Date of Patent: Jun. 12, 2012

(54) INSTALLATION SWITCHGEAR HAVING A LEAD-SEALABLE ACTUATION LEVER

(75) Inventors: Joachim Majewski, Dossenheim (DE); Klaus-Peter Eppe, Waldbrunn (DE)

(73) Assignee: ABB AG, Mannheim (DE)

( * ) Notice: Subject to any disclaimer, the term of this patent is extended or adjusted under 35 U.S.C. 154(b) by 338 days.

(21) Appl. No.: 12/596,465

(22) PCT Filed: Apr. 21, 2008

(86) PCT No.: PCT/EP2008/003180

§ 371 (c)(1),
(2), (4) Date: Oct. 19, 2009

(87) PCT Pub. No.: WO2008/128741

PCT Pub. Date: Oct. 30, 2008

(65) Prior Publication Data

US 2010/0108477 A1 May 6, 2010

(30) Foreign Application Priority Data

Apr. 20, 2007 (DE) ..... 10 2007 018 658

(51) Int. Cl.
*H01H 9/28* (2006.01)

(52) U.S. Cl. ..... 200/43.15

(58) Field of Classification Search ..... 200/43.15
See application file for complete search history.

(56) References Cited

U.S. PATENT DOCUMENTS

| | | | | |
|---|---|---|---|---|
| 3,312,794 | A | 4/1967 | Hollyday | |
| 4,677,261 | A * | 6/1987 | Nourry | 200/43.15 |
| 6,388,213 | B1 * | 5/2002 | Letient et al. | 200/43.15 |
| 6,563,063 | B1 | 5/2003 | Moore | |
| 2004/0099514 | A1 | 5/2004 | McCoy | |
| 2006/0070861 | A1 | 4/2006 | Bogdon et al. | |

FOREIGN PATENT DOCUMENTS

| | | | |
|---|---|---|---|
| DE | 3236023 | A1 | 3/1984 |
| DE | 102006058987 | A1 | 6/2008 |
| EP | 1643519 | A2 | 4/2006 |

OTHER PUBLICATIONS

International Search Report for PCT/EP2008/003180, mailed Aug. 27, 2008.

German Search Report for DE 10 2008 020 010.7, dated Aug. 11, 2009.

* cited by examiner

*Primary Examiner* — Renee Luebke

*Assistant Examiner* — Lheiren Mae Caroc

(74) *Attorney, Agent, or Firm* — Leydig, Voit & Mayer, Ltd.

(57) ABSTRACT

An installation switching device includes an insulating housing having a front face, and a switching handle disposed on the front face and configured to be operated by an operator and switched between a switched-on position and a switched-off position. The installation switching device also includes a slide fitted to the front face and moveable between a locked position and a released position. The slide is in the form of a frame and having at least one transverse web transverse to a movement direction of the slide and a holding projection configured to block any switching of the switching handle when the slide is in the locked position and to release the switching handle for switching when the slide is in the released position. The front face includes at least one structural element corresponding to the at least one transverse web. The installation switching device also includes a lead-sealing device configured to prevent movement of the slide from the locked position, wherein the at least one transverse web and the at least one structural element support the lead-sealing device.

10 Claims, 10 Drawing Sheets

INSTALLATION SWITCHGEAR HAVING A LEAD-SEALABLE ACTUATION LEVER

This is a U.S. National Phase Application under 35 U.S.C. §171 of International Application PCT/EP2008/003180, filed on Apr. 21, 2008, which claims priority to German Application No. DE 10 2007 018 658.6, filed on Apr. 20, 2007. The International Application was published in German on Oct. 30, 2008 as WO 2008/128741 under PCT Article 21(2).

The invention relates to an installation switching device having a lead-sealable operating lever.

BACKGROUND

Installation switching devices of this generic type are, for example, circuit breakers, residual current devices, motor protective switches, and main line circuit breakers. Within an insulating material housing, they have a switching apparatus, by means of which the current path which runs between an input terminal and an output terminal in the interior of the installation switching device can be interrupted or switched off, and can be switched on again.

The switching apparatus in the interior of the insulating material housing can in this case be switched on and off by an operator from the outside by means of a switching handle, which can be pivoted or rotated at least between a switched-on position and a switched-off position. The side of the installation switching device on which the switching handle is accessible for operation is referred to in the following text as the front face. The switching handle interacts in a suitable manner, which is known in principle, with the switching apparatus which is accommodated in the interior of the insulating material housing, such that the current path is switched on when the switching handle is in the switched-on position, and is switched off when the switching handle is in the switched-off position.

An installation switching device which switches one and only one current path between an input terminal and an output terminal is referred to as a single-pole installation switching device. If a plurality of current paths between a plurality of input terminals and a plurality of output terminals can be switched within one insulating material housing, then this is referred to as a multipole installation switching device. For example, three individual current paths, which each run between three input terminals and three output terminals, could be switched on or off at the same time by operation of a single switching handle in a three-pole installation switching device. A three-pole or multipole installation switching device can also be produced by arranging a plurality of single-pole devices in a row with their broad faces adjacent to one another, in which case the switching handles of the individual single-pole devices would need to be connected in a suitable manner, which is known in principle, in order to allow all the poles to be switched jointly.

It is often desirable to adopt suitable measures to ensure that the installation switching device may be operated only by authorized personnel. For this purpose, the switching handle is lead-sealed in one switch position, for example in the switched-on position, and the lead-seal may be released only by personnel authorized to do so, as a result of which manual disconnection can be carried out only by an operator who is authorized to do so. In precisely the same way, it would, of course, also be possible to use a lead-seal to ensure that only a person who is authorized to do so can switch the device on by hand.

A known technical apparatus for lead-sealing of the switching handle comprises the fitting of a front-face cover to the switching handle, with this cover being lead-sealed by means of a lead-sealed lock, for example, or a lead-sealing wire. However, the additional cover part required for this purpose could also be dispensed with, for cost reasons.

Other known technical apparatuses dispense with an additional cover part and, instead of this, provide a slide which is mounted in the switching handle, can be pulled out of the switching handle and overhangs the switching handle in the pulled-out state, with the part which overhangs said switching handle engaging in a holding groove which is located on the front face surface and corresponds with the switching handle in the lead-sealed position, where it can be lead-sealed in the pulled-out state. One example of an apparatus such as this is disclosed in DE 10 2006 058987, using the example of a lead-sealable rotary handle.

For example, in the case of installation switching devices having switching handles which can be moved linearly or can be tilted, it is known for two thin holes to be provided on the front face, which are separated transversely with respect to the movement direction of the switching handle and through which a lead-sealing wire can be passed, in such a way that the switching handle can be prevented from pivoting, by means of the lead-sealing wire or a lead-sealed lock. The housing of the installation switching device in this case assumed to be a standard housing, with there being no significant difference in the external contour between a lead-sealable embodiment and a normal embodiment. The holes on the front face may therefore only be made thin since, otherwise, it would be necessary to form a thicker bead in order to accommodate thick holes. Lead-sealing by means of a lead-sealed lock is therefore not possible, since the hasp of a lead-sealed lock is considerably thicker than a normal lead-sealing wire.

SUMMARY OF THE INVENTION

An aspect of the present invention is to further develop an installation switching device of this generic type such that multiple locking is possible by cumulative or alternative use of different lead-sealing means, for example by means of a lead-sealing wire or a lead-sealed lock, in a simple manner and without any major change to the external contour of the installation switching device.

Therefore, according to the invention, a slide which can move between a locked position and a released position and is in the form of a frame is fitted with a holding projection on the front face, with the holding projection on the slide blocking switching of the switching handle when in the lead-sealed position, and with the holding projection on the slide releasing the switching handle for switching when in the released position, and in which case it is possible to prevent movement of the slide from the lead-sealed position by lead-sealing means which are supported on the one hand on webs on the slide, which run transversely with respect to the movement direction of the slide, and on the other hand on structural elements on the front face of the housing, with the structural elements being firmly connected to the housing wall or being integrally formed on the housing wall.

The advantage of an installation switching device according to the invention is that the slide, which is in the form of a frame, and the corresponding structural elements can be made very flat, as a result of which this scarcely changes the external contour of the installation switching device. Since a slide which is in the form of a frame has at least two webs on the narrow faces, this results in at least two lead-sealing options, by using two different lead-sealing means, for the installation switching device according to the invention, for example by a lead-sealing wire and a padlock at the same time.

One advantageous embodiment of the invention is for a device combination formed from a plurality of individual poles, for example three individual poles, arranged in a row, in that a correspondingly longer slide is provided, which slide has a basic shape of a rectangular frame whose length corresponds to the width of the devices which are arranged in a row, and which is subdivided by intermediate webs into as many window elements as there are switch poles and therefore switching levers, with each window element corresponding to one switching lever of a single pole.

According to one advantageous embodiment, the holding projection is in the form of a flat tongue which extends from a web on the slide frame into the interior of the frame opening.

According to one advantageous embodiment of the invention, the tongue interacts with the switching lever such that, in the locked position, the tongue engages with a corresponding locking contour in the switching handle when in the locked position, thus providing coupling, which blocks switching of the switching handle, between the slide and the switching handle.

The slide can be moved parallel to the forward front face between a locked position and a released position.

For this purpose, according to a further advantageous embodiment, the slide has strips on the longitudinal webs of the basic shape, which is in the form of a frame, which strips can be guided such that they can move in corresponding grooves on the forward front face of the switching devices.

According to a further advantageous embodiment, the strips on the slide can be snapped onto the grooves, for mounting.

The slide can be lead-sealed in three different ways, cumulatively so to speak, in its locked position.

According to one advantageous embodiment, for a first type of lead-sealing, a first lead-sealing channel is formed in one of the webs, and a second lead-sealing channel which corresponds to the housing wall is formed on the housing wall, with both lead-sealing channels being covered in the lead-sealed position, such that a lead-sealing wire can be passed through both lead-sealing channels.

According to a further advantageous embodiment, a first lead-sealing channel is formed in one of the webs, through which lead-sealing channel a lead-sealing wire can be passed which is supported on a housing projection in the lead-sealed position, such that the slide cannot be moved when in the lead-sealed position. In this case, the lead-sealing wire can be supported on a corresponding projection on the housing, such that it cannot move laterally when the web of the slide covers it in the locked position.

According to one advantageous embodiment, for a second type of lead-sealing, one of the webs has a first indentation and the front face of the housing has a second indentation, with the two indentations being located on one another when the slide is in the locked position, such that they form a lead-sealing opening through which a padlock can be passed. The second type of lead-sealing is therefore provided by a padlock. The hasp can also be supported on a corresponding projection on the housing wall.

In one advantageous further embodiment, lead-sealing by means of a cable tie is possible, as a third type of lead-sealing, for an installation switching device according to the invention. For this purpose, when in the locked position, a cable tie can be passed through an opening which is formed between one of the webs on one of the narrow faces of the slide and an indentation in the housing wall, which cable tie is supported on the housing, for example on the broad face of the switching device or on the connecting edge between the broad face and the front face, when the slide is in the lead-sealed position. For this purpose, the invention provides for the slide to overhang the broad face of the housing by a small amount, in its locked position. This type of lead-sealing is particularly simple since there is no need to make any changes to the front face of the housing, and in particular there is no need to incorporate any additional lead-sealing holes on the front face of the housing.

A further highly advantageous embodiment provides for the slide to have a viewing opening which corresponds to a viewing window, which may be provided on the forward front face of the switching device, for a visual switch position indication. For this purpose, the slide has a viewing opening at the appropriate point in its longitudinal web, in order that the switch position indication can still be seen even when the slide is in place.

A further advantageous effect of the invention is that inadvertent movement of the switching handle can be prevented in a simple manner by moving the slide to the locked position, even when no lead-sealing means are used.

Further advantageous refinements and improvements of the invention, as well as further advantages, can be found in the dependent claims.

BRIEF DESCRIPTION OF THE DRAWINGS

The invention as well as further advantageous refinements and improvements of the invention will be explained and described in more detail with reference to the drawings, in which various embodiments of the invention are illustrated, and in which.

Components or elements which are the same or have the same effect are annotated with the same reference numbers in the figures.

DETAILED DESCRIPTION

Figure 1A:
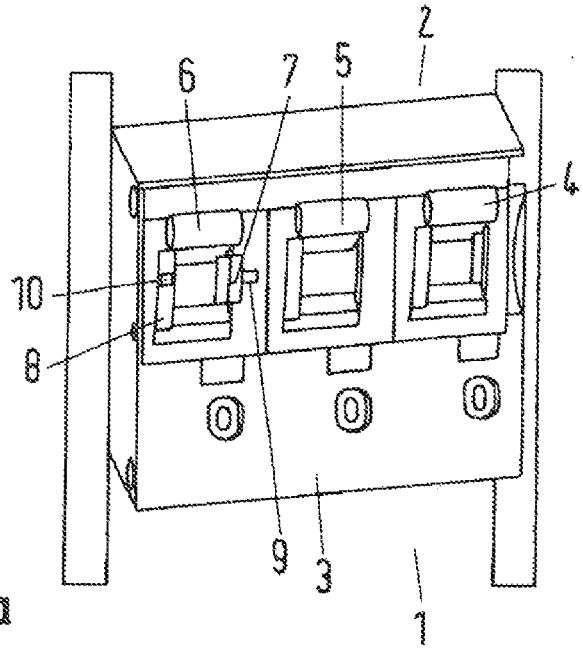
Fig.1a Prior Art
FIG. 1*a* shows an installation switching device according to the prior art.
Figure 1B:
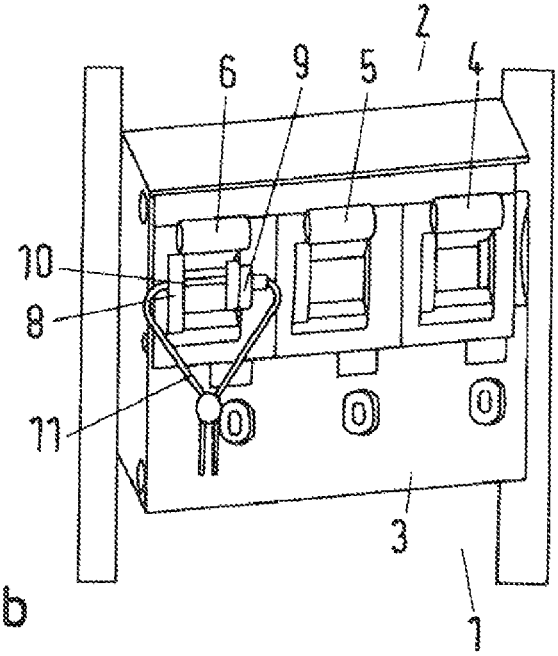
Fig.1b Prior Art
FIG. 1*b* shows the installation switching device as shown in FIG. 1*a*, lead-sealed by a lead-sealing wire.
Figure 2:
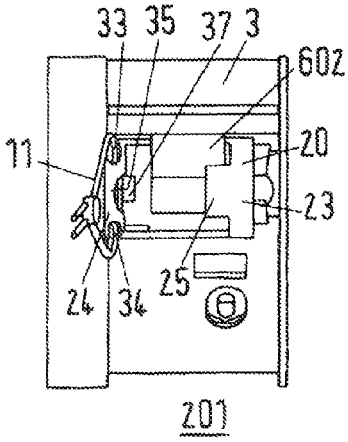
FIG. 2 shows a first embodiment of a single-pole installation switching device according to the invention, lead-sealed by a lead-sealing wire.

FIGS. 1*a* and 1*b* will be considered first of all, and they reflect the prior art. The figures show an installation switching device 2, for example a main line circuit breaker, which is installed in an installation distribution box 1. The device 2 is illustrated in the form of a plan view of its front face 3. This is an installation switching device with three switching poles, and three switching levers 4, 5, 6 are correspondingly provided, one for each switching pole. The switching levers are in the switched-on position, and are pivoted upward. A projection 7, 8 in the form of a bead is integrally formed on the front face 3 of the housing, in each case to the right and left of the switching lever 6. A hole 9, 10 is provided in each of the projections 7, 8 which are in the form of beads, through which hole 9, 10 a lead-sealing wire 11 can be passed, see FIG. 1*b*. The lead-sealing wire 11 then runs transversely in front of the switching lever 6, in such a way that this would tear the lead-sealing wire 11 if it were to be pivoted to the switched-off position, that is to say downward. This therefore prevents the device pole associated with the switching lever 6 from being switched off. However, as can be seen, only one lead-sealing option is provided, specifically that by means of a lead-sealing wire. Lead-sealing by means of the wire also does not offer effective protection against incorrect operation of the switching lever 6, because the thin lead-sealing wire cannot offer sufficient resistance against manual operation of the switching lever 6.

FIGS. 2, 3, 10, 11, 12, 13 and 14 will now be considered. These show various views and variants of a single-pole installation switching device according to the invention, having a switching lever 601. This comprises a slide 20, which is in the form of a frame and is formed from two longitudinal webs 21, 22, which run parallel, and two side webs 23, 24 which connect the longitudinal webs. A tongue 25 which points into the interior of the frame 20 is integrally formed on the right-hand side web 23. On the longitudinal webs 21, 22, the slide 20 has strips 26, 27 which, together with the longitudinal webs 21, 22, form an undercut. The front face 3 of the installation switching device has two grooves 28, 29 above and below the switching lever 601, which run transversely with respect to the pivoting direction of the switching lever 601. The slide 20 is latched to the strips 26, 27 in the grooves 28, 29, see FIG. 14, and can then be moved therein transversely with respect to the pivoting direction of the switching lever 601.

Figure 10:
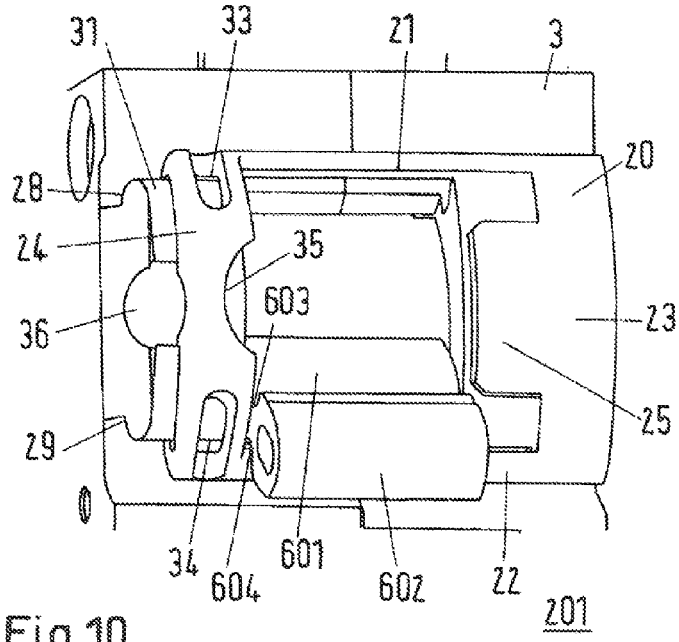
FIG. 10 shows a view obliquely from the front of an installation switching device as shown in FIG. 2, without lead-sealing and with the frame in the released position.

FIG. 10 shows the slide 20 in its released position. It has thus been pushed to the right such that the tongue 25 does not engage in the pivoting path of the switching lever 601, and the switching lever 601 can be pivoted.

Figure 13:
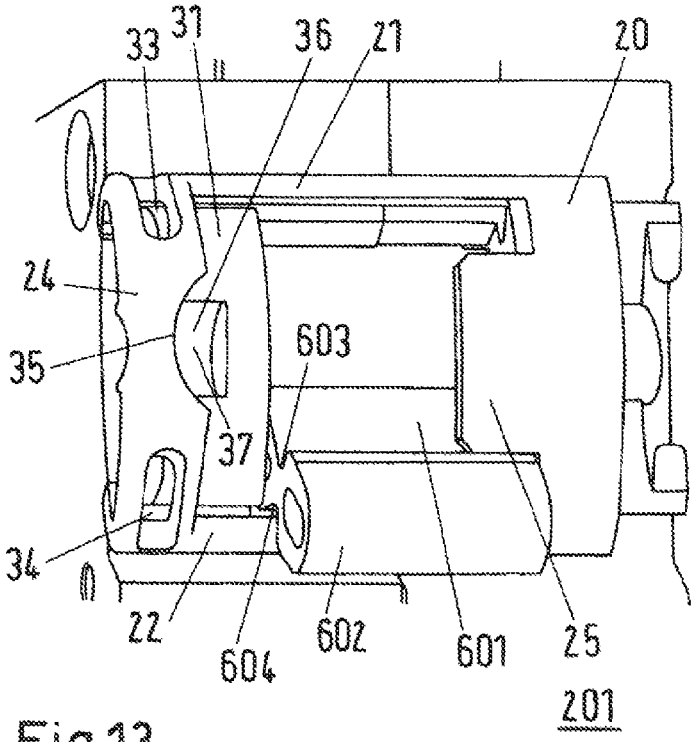
FIG. 13 shows the installation switching device as shown in FIG. 10, with the frame in the locked position.

In FIG. 13, the slide 20 has been moved to the left, to its locked position. The tongue 25 now lies in the pivoting path of the switching lever 601. At its operating end, the switching lever 601 has a switching knob 602. A lateral groove 603 is formed where the switching knob 602 is attached to the switching lever 601. In the locked position, the free end of the tongue 25 engages in the lateral groove 603. This results in the switching lever being blocked mechanically strongly in its respective switch position. It can now be pivoted only by applying major force, and inadvertent pivoting with the slider 20 in the locked position is no longer possible.

In the illustration in FIG. 13, the switching lever 601 is held firmly in its lower position, the switched-off position. In addition to the above transverse groove 603, a lower transverse groove 604 has also been formed where the switching knob 602 is attached to the switching lever 601. This is used to also allow the switching lever 601 to be held firmly in its upper position, the switched on-position, by the tongue 25 of the slide 20 in its locked position.

The slide 20 according to the invention therefore makes it possible to prevent inadvertent switching of the switching lever 601 of the installation switching device when the slide 20 is in its locked position.

The slide 20 may however, furthermore, be lead-sealed in its locked position by various options, which can also be used cumulatively. This will now be explained in the following text.

Figure 14:
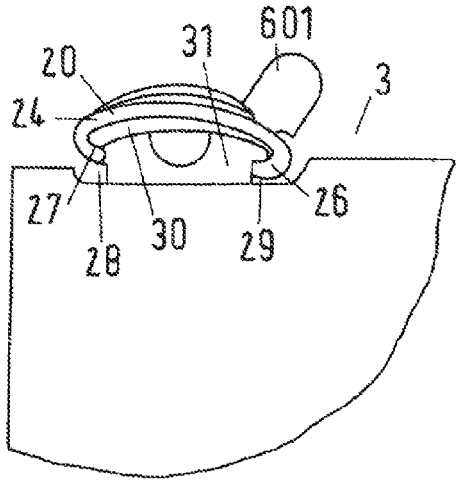
FIG. 14 shows a side view of an installation switching device according to the invention, with the frame snapped on, FIG. 15 shows a side view and a plan view of a frame according to the invention.
Figure 15:
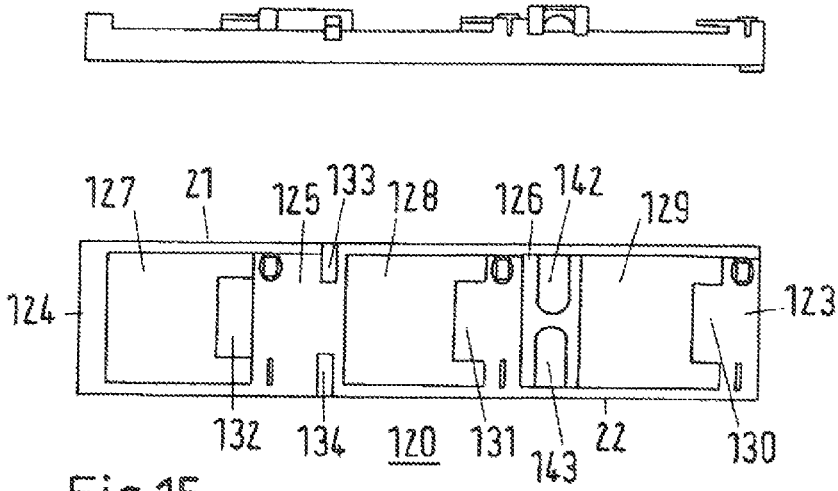

As can be seen from FIG. 14, the slide 20 has a covered surface which is curved outward, that is to say the side webs 23, 24 are curved outward. This results in a dome-like cavity 30 being created on the side of the side webs 23, 24 of the slide 20 facing the front face 3 of the installation device. A projection 31, 32 in the form of a bead is correspondingly integrally formed in each case on the front face 3 of the installation switching device, and its external contour forms a curvature that is directed outward. The curved surface of the projection 31, which is in the form of a bead, in this case fits into the dome-like cavity in the web 24 of the slide 20, as a result of which the web 24 rests over the surface of the projection 31, which is in the form of a bead.

In the area of the connection to the longitudinal webs 21, 22, the left-hand side web 24 of the slide 20 in each case has an opening 33, 34. A channel is formed, so to speak, by the openings 33, 34 and the dome-like cavity 30 located underneath the web 24, through which channel a lead-sealing wire can be passed, for which reason this is also referred to as a lead-sealing channel. In the locked position, the lead-sealing channel is located to the left, alongside the projection 31 which is in the form of a bead. When a lead-sealing wire 11 is now passed through the lead-sealing channel, then the lead-sealing wire 11 is supported on the side surface of the projection 31, which is in the form of a bead, see FIG. 12 and FIG. 2. The slide 20 is now lead-sealed in its locked position.

Furthermore, the left-hand side web 24 also has a bulge 35 which is open toward the interior of the frame. The projection 31 which is in the form of a bead also has a bulge 36, which opens outward. The bulge 36 forms, so to speak, a groove, which is open outward, within the projection 31 which is in the form of a bead. When the slide 20 is in the locked position, the bulge 35 on the web 24 is therefore located above the bulge 36 on the projection 31 which is in the form of a bead, thus creating an access opening 37 to the bulge 36 within the projection 31 which is in the form of a bead. In this position, the access opening 37 is sufficiently large that a hasp 39 of a padlock 38 can be passed through it. The hasp then prevents the slide 20 from being moved back to the released position.

Figure 3:
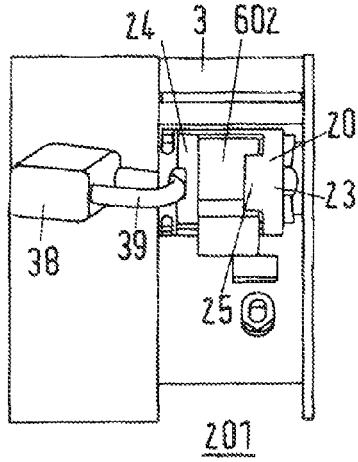
FIG. 3 shows the installation switching device as shown in FIG. 2, lead-sealed by a padlock.
Figure 4:
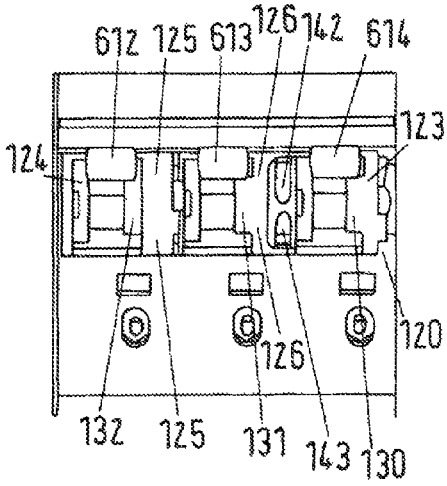
FIG. 4 shows a second embodiment of a three-pole installation switching device according to the invention, with the slide, which is in the form of a frame, being used only for locking, and not for lead-sealing.
Figure 11:
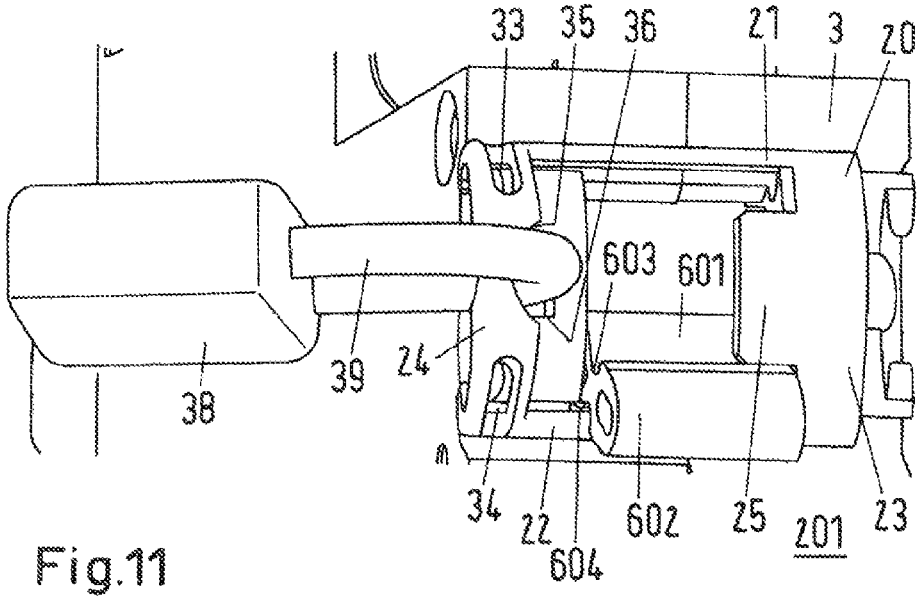
FIG. 11 shows a view obliquely from above of the installation switching device as shown in FIG. 3.
Figure 12:
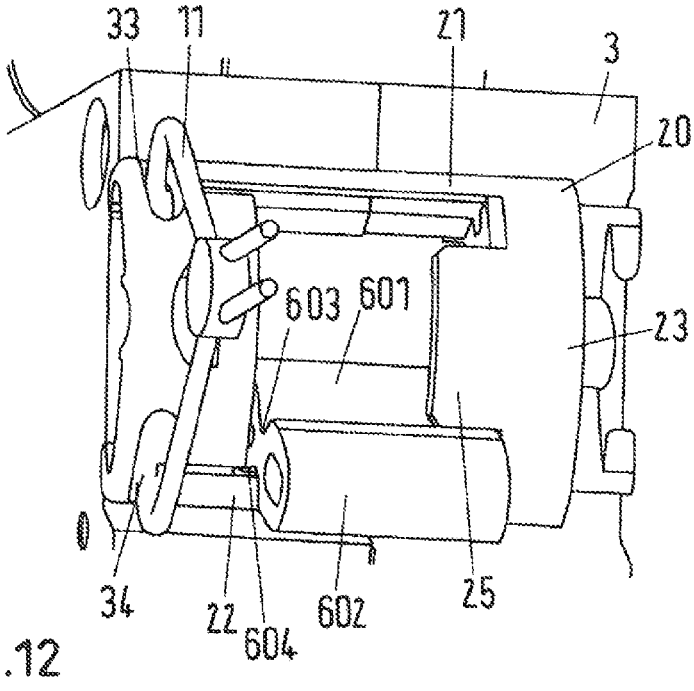
FIG. 12 shows a view obliquely from the front of the installation switching device as shown in FIG. 2.

In addition, the slide 20 can therefore also be lead-sealed in its locked position by a padlock 38, see FIG. 11 and FIG. 3.

The lead-sealing by means of the hasp and a lead-sealing wire can also be carried out cumulatively, as a result of which the slide 20 would then have double protection against unauthorized movement from its locked position.

Figure 5A:
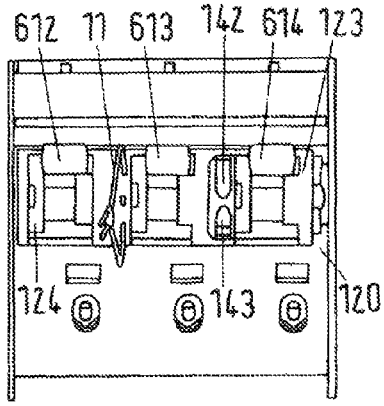
FIG. 5*a* shows the installation switching device as shown in FIG. 4, lead-sealed by a lead-sealing wire.
Figure 5B:
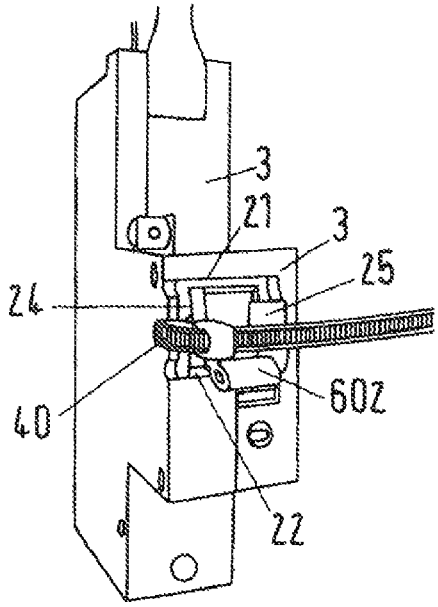
FIG. 5*b* shows a third embodiment of a single-pole installation switching device according to the invention, lead-sealed by a cable tie.

FIG. 5*b* shows a further lead-sealing option. In this case, instead of a padlock, a cable tie 40 is passed through the access opening and the groove, and prevents the slide 20 from being pushed back to its released position.

FIGS. 4, 5*a*, 6, 7*a*, 7*b*, 7*c*, 8, 9 and 15 will now be considered. These show various views and variants of a three-pole installation switching device 202 according to the invention, with three switching levers 612, 613, 614. The slide 120 according to the invention is designed in the same way as the slide 20 as described above for the single-pole device, but it is now correspondingly longer, as a result of which it covers all three switching levers 612, 613, 614. In addition to the two side webs 123, 124, the slide 120 has two transverse webs 125, 126 arranged between them, which subdivide three windows 127, 128, 129 in the interior of the slide frame. Each of the three windows 127, 128, 129 is associated with one of the three switching levers 612, 613, 614.

The locking function of the slide 120 is implemented in a similar manner to that described above for the slide 20 in the single-pole device. Tongues 130, 131, 132 are integrally formed on the right-hand side web 123 and on the transverse webs 125, 126, project into the window area, which is in each case located to the left of the associated web, and lock the three switching handles 612, 613, 614 when the slide 120 has been pushed to the left, to the locked position, see FIG. 8.

The lead-sealing aids which are provided on the side web 24 of the single-pole slide 20, specifically the openings 33, 34 and the bulge 35, are not present in the case of the corresponding left-hand side web 124 of the slide 120. Instead of this, openings 133, 134 are incorporated in the first transverse web 125. In a corresponding manner to the projection 31, which is in the form of a bead, in the case of the single-pole installation switching device, projections 131, 138, 139, which are in the form of beads, are in this case integrally formed, on the front face of the housing in the area of the left-hand side web 124 and of the two transverse webs 125, 126, and each themselves have a bulge 136, 140, 141 whose form and function correspond to the bulge 36 in the case of the single-pole switching device.

Figure 7A:
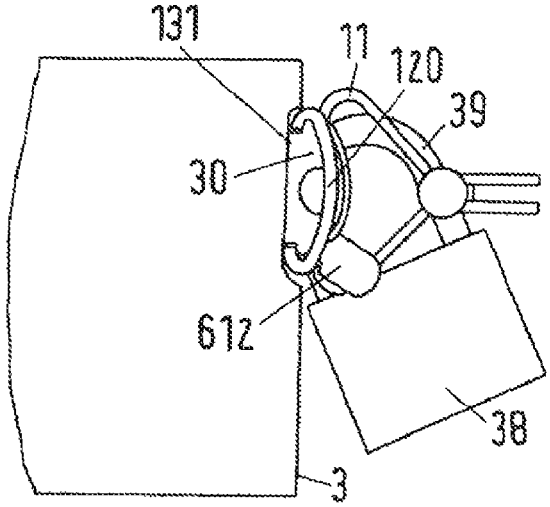
FIG. 7*a* shows a side view of an installation switching device according to the invention, with lead-sealing being provided cumulatively by a lead-sealing wire and a padlock.
Figure 7B:
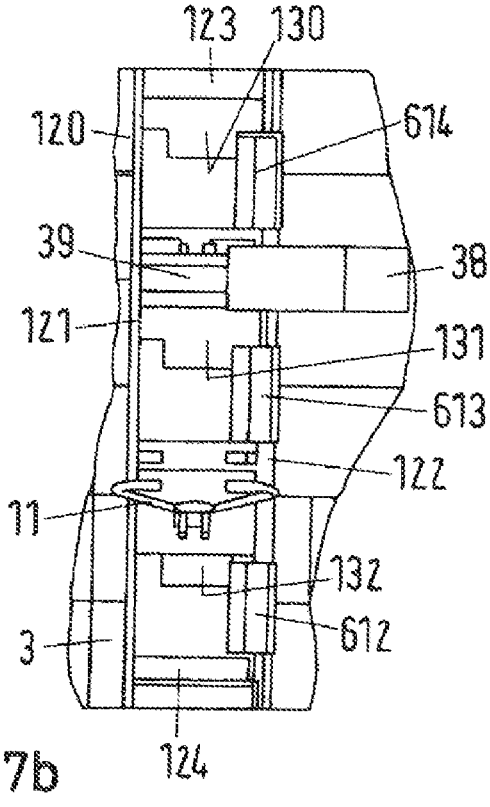
FIG. 7*b* shows the view of the front face of the installation switching device as shown in FIG. 7*a*.
Figure 7C:
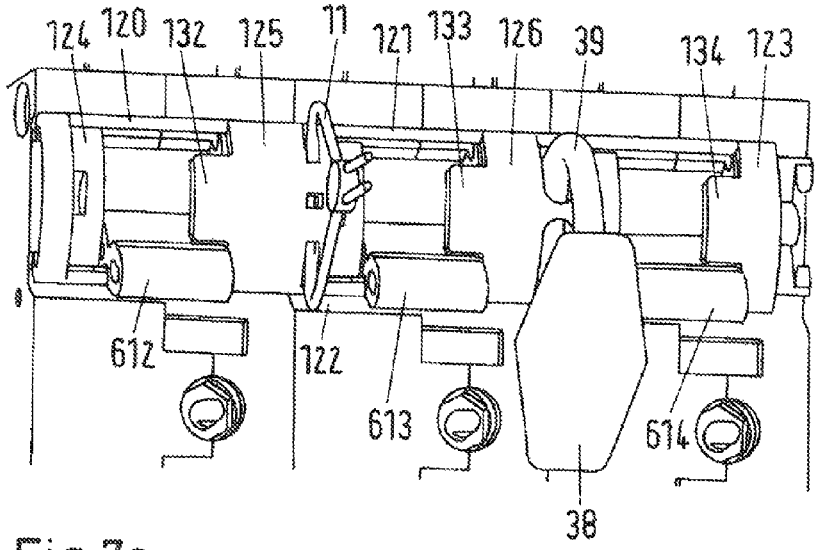
FIG. 7*c* shows a view obliquely from the front of the front face of the installation switching device shown in FIG. 7*a*.
Figure 8:
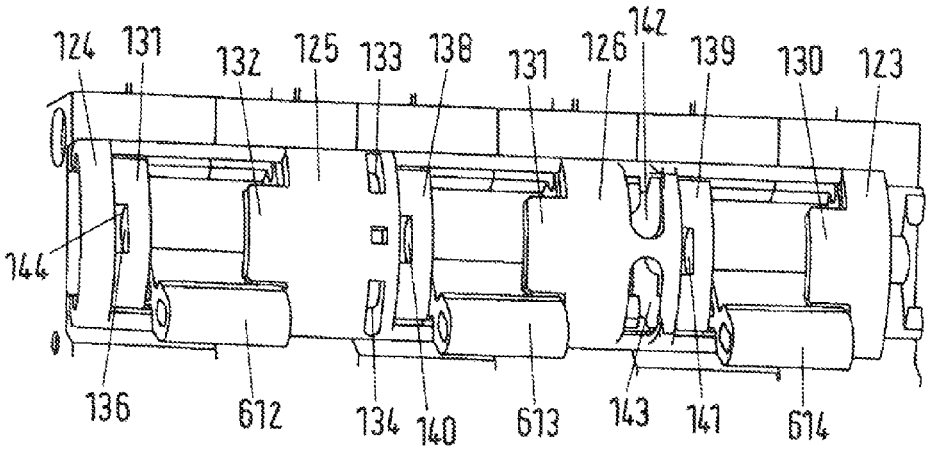
FIG. 8 shows a view obliquely from the front of the installation switching device as shown in FIG. 4, in the locked position.
Figure 9:
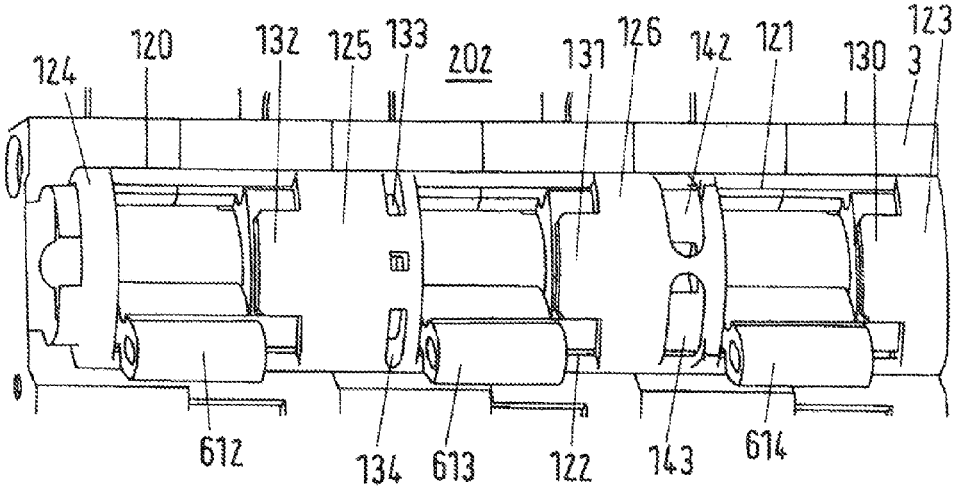
FIG. 9 shows the installation switching device as shown in FIG. 8, in the released position.

The lead-sealing by means of a lead-sealing wire 11 is therefore provided on the first transverse web 125, see FIG. 7*c*, FIG. 7*b*, FIG. 5.

Instead of the openings which are matched to the diameter of a lead-sealing wire, the second transverse web 126 has two cutouts 142, 143, which open outward in a U-shape and are matched to the diameter of the hasp of a padlock. Lead-sealing by means of a padlock can thus be carried out on the second transverse web 126, see FIG. 7*c*, FIG. 7*b*. FIG. 7*a* shows the redundant lead-sealing by means of a padlock and a lead-sealing wire, in the form of a side view.

Figure 6:
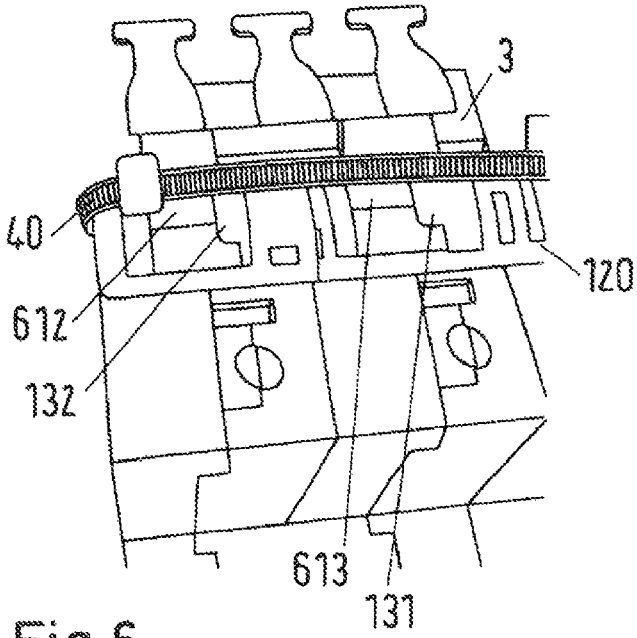
FIG. 6 shows a fourth embodiment of a three-pole installation switching device according to the invention, lead-sealed by a cable tie.

As a third option for lead-sealing, a cable tie 40 can be passed through the opening 144 which is released between the left-hand side web 124 and the bulge 136 in the projection 131 which is in the form of a bead, see FIG. 6. A triple-redundant lead-sealing option is therefore provided for the three-pole installation switching device with the slide according to the invention.

Figure 16:
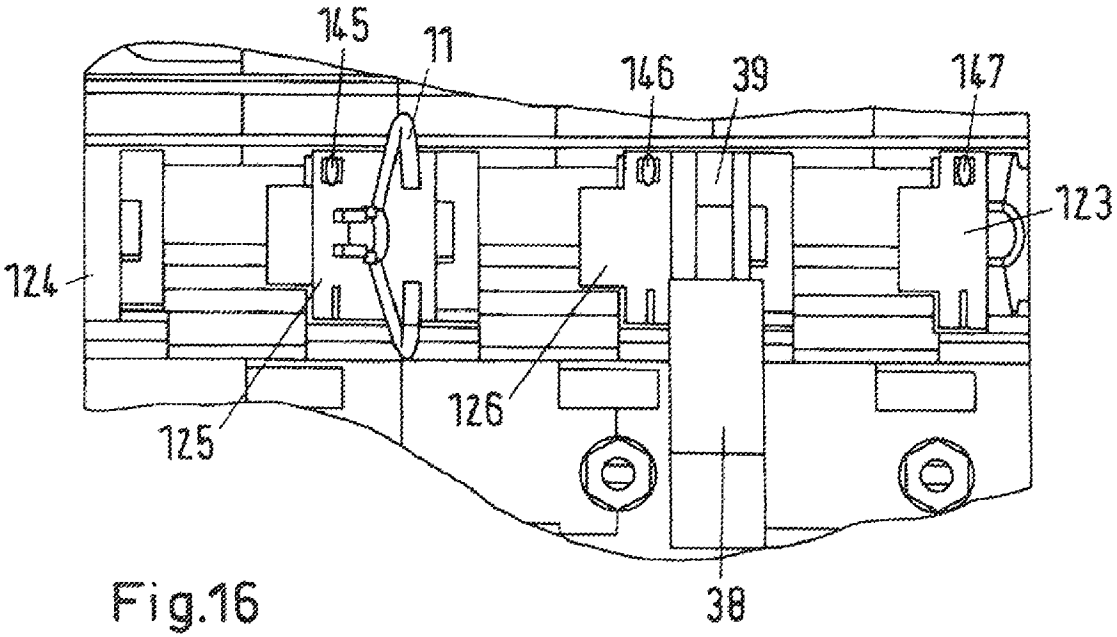
FIG. 16 shows a plan view of a further embodiment of an installation switching device according to the invention, in which viewing windows are incorporated in the frame.

FIG. 16 will now be considered. The difference from the figures described above is that a viewing opening 145, 146, 147 is in each case provided in the transverse webs 125, 126 and the right-hand side web 124, which viewing opening coincides with a viewing window, which is likewise provided on the front face of the switching device, for a switch position indication—this is known in principle—when the slide 120 is in the locked position. When the operator views the front face of the switching device, he can therefore determine the switching state the device is in, even when the slide is locked and lead-sealed. The position of the switching lever on its own might not be sufficient for this purpose. This is because, in the event of overcurrent or short-circuit current tripping of the selective main line circuit breaker, a latching mechanism in the interior of the switching device is unlatched, as a result of which the switching contact point is permanently opened. However, when the switching lever is held firmly in its switched-on position by the locking apparatus of the slide, it is then not possible to read the internal switching state of the switching device from it. A visual switch position indication, which is known in principle, may, however, signal the transition from the switched-on state to the switched-off state in the interior of the switching device. It is therefore advantageous for this switch position indication not to be completely covered by the slide.

List of Reference Symbols

| | |
|---|---|
| 1 | Installation distribution box |
| 2 | Installation switching device |
| 3 | Front face |
| 4 | Switching lever |
| 5 | Switching lever |
| 6 | Switching lever |
| 7 | Projection in the form of a bead |
| 8 | Projection in the form of a bead |
| 9 | Hole |
| 10 | Hole |
| 11 | Lead-sealing wire |
| 20 | Slide |
| 21 | Longitudinal web |
| 22 | Longitudinal web |
| 23 | Side web |
| 24 | Side web |
| 25 | Tongue |
| 26 | Strip |
| 27 | Strip |
| 28 | Groove |
| 29 | Groove |
| 30 | Dome-like cavity |
| 31 | Projection in the form of a bead |
| 32 | Projection in the form of a bead |
| 33 | Opening |
| 34 | Opening |
| 35 | Bulge |
| 36 | Bulge |
| 37 | Opening |
| 38 | Padlock |
| 39 | Hasp |
| 40 | Cable tie |
| 120 | Slide |
| 123 | Side web, right |
| 124 | Side web, left |
| 125 | First transverse web |
| 126 | Second transverse web |
| 127 | Window |
| 128 | Window |
| 129 | Window |
| 130 | Tongue |
| 131 | Tongue |
| 132 | Tongue |
| 133 | Opening |
| 134 | Opening |
| 135 | Projection in the form of a bead |
| 136 | Bulge |
| 138 | Projection in the form of a bead |
| 139 | Projection in the form of a bead |

-continued

| | |
|---|---|
| 140 | Bulge |
| 141 | Bulge |
| 142 | U-shaped cutout |
| 143 | U-shaped cutout |
| 144 | Opening |
| 145 | Viewing opening |
| 146 | Viewing opening |
| 147 | Viewing opening |
| 201 | Installation switching device, 1-pole |
| 202 | Installation switching device, 3-pole |
| 601 | Switching lever |
| 602 | Switching knob |
| 603 | Transverse groove |
| 604 | Transverse groove |
| 612 | Switching lever |
| 613 | Switching lever |
| 614 | Switching lever |

The invention claimed is:

1. An installation switching device comprising:

an insulating housing having a front face;

a switching handle disposed on the front face and configured to be operated by an operator and switched between a switched-on position and a switched-off position;

a slide fitted to the front face and moveable between a locked position and a released position, the slide being in the form of a frame and having at least one transverse web transverse to a movement direction of the slide and a holding projection configured to block any switching of the switching handle when the slide is in the locked position and to release the switching handle for switching when the slide is in the released position, the holding projection including a flat tongue extending from the at least one transverse web into an interior of an opening of the frame, the flat tongue being configured to engage with a corresponding locking contour in the switching handle when the slide is in the locked position so as to provide a coupling between the slide and the switching handle, the coupling blocking a switching of the switching handle, wherein the front face includes at least one structural element corresponding to the at least one transverse web; and a lead-sealing device configured to prevent movement of the slide from the locked position, wherein the at least one transverse web and the at least one structural element support the lead-sealing device.

2. The installation switching device as recited in claim 1, wherein the slide is movable parallel to the front face between the locked position and the released position.

3. The installation switching device as recited in claim 1, wherein a first lead-sealing channel is formed in the at least one transverse web and a second lead-sealing channel corresponds to and is formed on a housing wall, wherein the first and the second lead-sealing channels overlap when the slide is in a lead-sealed position such that a lead sealing wire of the lead-sealing device can be passed through the first and the second lead-sealing channels.

4. The installation switching device as recited in claim 1, wherein the slide includes a viewing opening corresponding to a viewing window provided on the front face so as to provide a visual switch position indication.

5. An installation switching device comprising:

an insulating housing having a front face;

a switching handle disposed on the front face and configured to be operated by an operator and switched between a switched-on position and a switched-off position;

a slide fitted to the front face and moveable between a locked position and a released position, the slide being in the form of a frame and having at least one transverse web transverse to a movement direction of the slide and a holding projection configured to block any switching of the switching handle when the slide is in the locked position and to release the switching handle for switching when the slide is in the released position, wherein the front face includes at least one structural element corresponding to the at least one transverse web, wherein the slide includes longitudinal webs running parallel to the moving direction of the slide, the longitudinal webs each having a strip configured to be guided along a corresponding groove on the front face; and a lead-sealing device configured to prevent movement of the slide from the locked position, wherein the at least one transverse web and the at least one structural element support the lead-sealing device.

6. The installation switching device as recited in claim 5, each strip can be snapped onto the corresponding groove.

7. An installation switching device comprising:

an insulating housing having a front face;

a switching handle disposed on the front face and configured to be operated by an operator and switched between a switched-on position and a switched-off position;

a slide fitted to the front face and moveable between a locked position and a released position, the slide being in the form of a frame and having at least one transverse web transverse to a movement direction of the slide and a holding projection configured to block any switching of the switching handle when the slide is in the locked position and to release the switching handle for switching when the slide is in the released position, wherein the front face includes at least one structural element corresponding to the at least one transverse web, wherein the at least one tranverse web is an intermediate web and wherein a first lead-sealing channel is formed in the intermediate web, wherein the structural element includes a projection and wherein a lead sealing wire can be passed through the first lead-sealing channel and is supported by the projection in a lead-sealed position; and a lead-sealing device configured to prevent movement of the slide from the locked position, wherein the at least one transverse web and the at least one structural element support the lead-sealing device.

8. An installation switching device comprising:

an insulating housing having a front face;

a switching handle disposed on the front face and configured to be operated by an operator and switched between a switched-on position and a switched-off position;

a slide fitted to the front face and moveable between a locked position and a released position, the slide being in the form of a frame and having at least one transverse web transverse to a movement direction of the slide and a holding projection configured to block any switching of the switching handle when the slide is in the locked position and to release the switching handle for switching when the slide is in the released position, wherein the front face includes at least one structural element corresponding to the at least one transverse web, wherein the at least one transverse web includes a first and a second transverse web and wherein one of the first and second transverse web includes a first indentation, and wherein the front face includes a second indentation disposed adjacent relative to the first indentation so as to form a lead-sealing opening when the slide is in the locked position, wherein the lead sealing device include a padlock which can pass through the lead-sealing opening when the slide is in the locked position; and a lead-sealing device configured to prevent movement of the slide from the locked position, wherein the at least one transverse web and the at least one structural element support the lead-sealing device.

9. An installation switching device comprising:

an insulating housing having a front face;

a switching handle disposed on the front face and configured to be operated by an operator and switched between a switched-on position and a switched-off position;

a slide fitted to the front face and moveable between a locked position and a released position, the slide being in the form of a frame and having at least one transverse web transverse to a movement direction of the slide and a holding projection configured to block any switching of the switching handle when the slide is in the locked position and to release the switching handle for switching when the slide is in the released position, wherein the front face includes at least one structural element corresponding to the at least one transverse web, wherein the lead-sealing device includes a cable tie configured to be passed through an opening formed between the at least one transverse web and an indentation in the front face, wherein the cable tie is supported on the front face when the slide is in a lead-sealed position; and a lead-sealing device configured to prevent movement of the slide from the locked position, wherein the at least one transverse web and the at least one structural element support the lead-sealing device.

10. An installation switching device comprising:

an insulating housing having a front face;

a switching handle disposed on the front face and configured to be operated by an operator and switched between a switched-on position and a switched-off position;

a slide fitted to the front face and moveable between a locked position and a released position, the slide being in the form of a frame and having at least one transverse web transverse to a movement direction of the slide and a holding projection configured to block any switching of the switching handle when the slide is in the locked position and to release the switching handle for switching when the slide is in the released position, wherein the front face includes at least one structural element corresponding to the at least one transverse web, wherein the at least one transverse web includes a plurality of transverse webs that subdivide the slide into a plurality of windows, each one of the plurality of windows corresponding to one of a plurality of switching levers, wherein each transverse web including a respective holding projection projecting into each of the plurality of windows; and a lead-sealing device configured to prevent movement of the slide from the locked position, wherein the at least one transverse web and the at least one structural element support the lead-sealing device.

* * * * *